United States Patent [19]

Gainer

[11] 4,197,091

[45] Apr. 8, 1980

[54] METAL CHELATE/ANTI-OXIDANT COMBINATIONS WITH DIMER-TRIMER ACIDS, PIPELINE CORROSION INHIBITORS

[75] Inventor: Alvis B. Gainer, Houston, Tex.

[73] Assignee: Nalco Chemical Co., Oak Brook, Ill.

[21] Appl. No.: 29,588

[22] Filed: Apr. 12, 1979

[51] Int. Cl.[2] ..... C10L 1/22

[52] U.S. Cl. ..... 44/71; 44/66; 44/77; 252/390; 252/393

[58] Field of Search ..... 44/71, 66, 77; 252/390, 252/393

[56] References Cited

U.S. PATENT DOCUMENTS

| | | | |
|---|---|---|---|
| 2,482,761 | 9/1949 | Goebel | 260/407 |
| 2,904,415 | 9/1959 | Boies et al. | 44/66 |
| 2,984,550 | 5/1961 | Chamot | 44/62 |
| 3,912,771 | 10/1975 | Kuhn et al. | 44/71 |
| 4,002,437 | 1/1977 | Broechx et al. | 44/66 |
| 4,072,474 | 2/1978 | Kuhn et al. | 44/66 |

*Primary Examiner*—Winston A. Douglas
*Assistant Examiner*—J. V. Howard
*Attorney, Agent, or Firm*—John G. Premo; Robert A. Miller

[57] ABSTRACT

A composition for inhibiting the corrosion of ferrous metal pipelines used to transport petroleum hydrocarbons comprising a major portion of a mixture of $C_{36}$ dicarboxylic dimer acid and a $C_{54}$ trimer acid, which mixture has an acid number of at least 110 and from 0.5 up to about 5% of a composition from the group consisting of:

(a) an N,N'-di(ortho-hydroxyarylidene)-1,2-alkylenediamine in which the arylidene radical contains 6–7 carbon atoms and the alkylene radical contains 2–3 carbon atoms; and (b) a polymeric condensation product obtained by the reaction of a phenol having two reactive ring positions, a lower aliphatic aldehyde having 1–2 carbons, and a polyamine having a reactive hydrogen atom on at least two amino nitrogens, said condensation product being formed by condensing the foregoing reactants at a molar ratio of 2 mols of said aldehyde per mol of said phenol and a molar ratio of phenol to polyamine in the range of 1:1 to 2:1, respectively, at an elevated reaction temperature sufficient to form a polymerized condensation product.

2 Claims, No Drawings

METAL CHELATE/ANTI-OXIDANT COMBINATIONS WITH DIMER-TRIMER ACIDS, PIPELINE CORROSION INHIBITORS

INTRODUCTION

It is now known that pipelines constructed of ferrous metals used to transport petroleum products, both refined and unrefined, corrode due to the fact that the petroleum products contain quantities of water and traces of corrosive impurities including oxygen. The problem is particularly severe when the pipelines are used to transport gasoline and other light petroleum distillate products. In order to protect the pipelines from this corrosive environment, it is now common to treat the fluids transported by these pipelines with small quantities of corrosion inhibitors. One such group of products is the so-called polymerized fatty acids which are formed by homopolymerizing fatty dienoic acids such as linoleic acid or polymerizing fatty dienoic acids with monethylinically unsaturated fatty acids such as oleic acid. A method of preparing these acids is described in U.S. Pat. No 2,904,415, and in the publication, *Industrial and Engineering Chemistry,* 32, p. 802 et subs (1940). The method of polymerizing these unsaturated acids to produce the dimers and trimers is described in U.S. Pat. No. 2,482,761. The disclosures of all of these references are incorporated by reference herein.

A preferred pipeline inhibitor is a blend of polymerized fatty acids formed by the polymerization of linoleic acid with oleic acid which produces a blend of dimer and trimer acids such that the trimer acid content is within the range of 9–36% and, preferably, 14%, with the balance being dimer acid. The preferred polymerized acids used as inhibitors of the type described should have an acid number of at least 110 and, preferably, greater than 150.

While these polymerized fatty acids give protection to the ferrous metals of pipelines transmitting petroleum products, the protection is not complete since they are incapable of preventing red rust. It would be of great benefit to the art if it were possible to find an additive which, when added to the polymerized fatty acid inhibitors, would improve their ability to inhibit corrosion in pipelines used to transmit petroleum and petroleum products.

THE INVENTION

A composition for inhibiting the corrosion of ferrous metal pipelines used to transport petroleum hydrocarbons coomprising a major portion of a mixture of $C_{36}$ dicarboxylic dimer acid and a $C_{54}$ trimer acid, which mixture has an acid number of at least 110 and from 0.5 up to about 5% of a composition from the group consisting of:

(a) an N,N'-di(ortho-hydroxyarylidene) - 1,2-alkylenediamine in which the arylidene radical contains 6–7 carbon atoms and the alkylene radical contains 2–3 carbon atoms; and (b) a polymeric condensation product obtained by the reaction of a phenol having two reactive ring positions, a lower aliphatic aldehyde having 1–2 carbons, and a polyamine having a reactive hydrogen atom on at least two amino nitrogens, said condensation product being formed by condensing the foregoing reactants at a molar ratio of 2 mols of said aldehyde per mol of said phenol and a molar ratio of phenol to polyamine in the range of 1:1 to 2:1, respectively, at an elevated reaction temperature sufficient to form a polymerized condensation product. These products are Mannich polymers.

It is preferred that the above compositions be diluted with a suitable hydrocarbon liquid such as a fuel oil, kerosene, naphtha, stoddard solvent or the like. This makes them fluid and easy to meter into the fluids contained in the pipelines which tend to be corrosive. The amount of the compositions of the invention capable of providing nearly 0% corrosion, as will be demonstrated hereinafter, vary as little as 0.01 up to as much as 2 lbs. per thousand barrels (PTB) based on the weight of the fluid being treated.

N,N'-di-(ortho-hydroxyarylidene)-1,2-alkylenediamine

In these compounds the arylidene radical contains 6–7 carbon atoms and the alkylene radical contains 2–3 carbon atoms, i.e. 1,2-ethylene and 1,2-propylene. Preferred metal deactivators are N,N'-disalicylidene-1,2-propylene-diamine and N,N'-disalicylidene-1,2-ethylenediamine with the former being most preferred.

The Mannich Polymers

These polymers are described in detail in U.S. Pat. No. 2,984,550, the disclosure of which is incorporated herein by reference. This patent teaches the use of these polymers as cooler stabilizers for fuel oils.

The phenolic materials are alkyl phenols which contain from 2 to 18 carbon atoms and, preferably, 8 to 18 carbon atoms. A preferred starting phenol is para-dodecyl phenol. Other phenols that may be used are octyl phenol, p-nonyl phenol, isooctyl phenol, hexyl phenol, and octodecyl phenol, with these compounds being illustrative.

The Aldehydes

The aldehyde preferably is formaldehyde in any of its commercially available forms such as formalin (40% aqueous formaldehyde solution,) paraformaldehyde, alcoholic solutions (the formcels) and trioxane. Acetaldehyde may also be used.

The Polyamines

The diamines are preferably alkylene diamines but may be aryl diamines, preferably having at least one primary amine group. Ethylene diamine, propylene diamine, butylene diamine, pentamethylene diamine, and hexamethylene diamine are primary diamines which may be used in preparing the compositions of this invention. Presently, ethylene diamine and hexamethylene diamine are the two most available in commercial quantities. Substituted alkylene diamines such as ethyl ethylene diamine, hydroxyethyl ethylene diamine, N,N' dihydroxy ethyl ethylene diamine and N-ethyl, N'-amino ethyl ethylene diamine may also be used. Other diamines such as diamino ethyl ether and diamino ethyl thioether may also be employed. Hydrazine may be used also.

The polyamines, having three or more amino groups, may be an unsubstituted or partially substituted polyalkylene polyamines, preferably having at least one primary amine group. Diethylene triamine, triethylene tetramine and tetraethylene pentamine are polyalkylene polyamines having two primary amino groups. Others include corresponding polypropylene polyamines. Other polyamine compositions which may be used are compositions which are higher homologs of the foregoing polyamines and which are usually available as mixtures obtained as residues in the production of the foregoing polyamines. The polyalkylene polyamines may be partially substituted as, for example, monoamido polyalkylene polyamines and N-alkyl or N-hydroxylalkyl substituted polyalkylene polyamines having at least two primary and/or secondary amine groups.

Listed below is a typical Mannich polymer useful in preparing the compositions of the invention:

| Formula* | |
|---|---|
| Ingredients | % by weight |
| Formaldehyde, 37° Inhibited | 19.5 |
| Ethylene diamine 99% | 7.3 |
| P-dodecyl Phenol | 31.5 |
| Heavy Aromatic Naphtha Exxon | 41.7 |

*Molecular weight about 693.8 relative to a polystyrene standard.

In Formula A above, 50% of the condensation product is a bis phenol believed to have the structural formula:

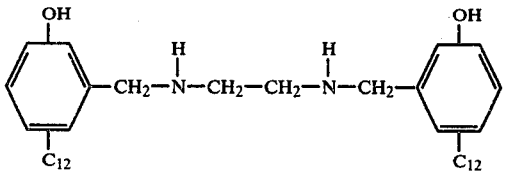

whereas the remaining portion is believed to have the structural formula:

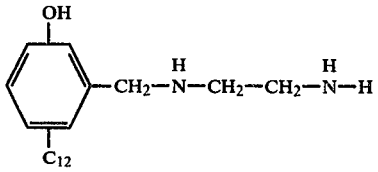

EXAMPLES

To illustrate the effectiveness of the invention, the compositions of the invention along with the mixed polymerized acids alone and a commercial inhibitor were tested using Military Test MIL-I-25017C, 8 Mar. 1971, superseding MIL-I-25017B, 22 Oct. 1962. Grade 1018 steel spindles are tested for rust formation in stirred isooctane-synthetic seawater mixtures.

The results of these tests using depolymerized isooctane as test fluid are set forth below in Table I.

Table I

| Composition Used | PTB Concentration | % Rust |
|---|---|---|
| Formula A | 2 | 6, 12 |
| 45% dimer, 15% trimer, 2% Formula A, 38% oil* | 2 | <0.1, 0 |
| 45% dimer, 15% trimer, 2% N,N'disalicylidene-1,2-propylene-diamine, 38% oil | 2 | <0.1, 1 |
| 45% dimer, 15% trimer, 40% oil | 2 | 4,4 |

*Fuel oil.

I claim:

1. A composition for inhibiting the corrosion of ferrous metal pipelines used to transport petroleum hydrocarbons comprising a major portion of a mixture of $C_{36}$ dicarboxylic dimer acid and a $C_{54}$ trimer acid, which mixture has an acid number of at least 110 and from 0.5 up to about 5% of a composition from the group consisting of:

(a) an N,N'-di(ortho-hydroxyarylidene) - 1,2-alkylenediamine in which the arylidene radical contains 6–7 carbon atoms and the alkylene radical contains 2–3 carbon atoms; and (b) a polymeric condensation product obtained by the reaction of a phenol having two reactive ring positions, a lower aliphatic aldehyde having 1–2 carbons, and a polyamine having a reactive hydrogen atom on at least two amino nitrogens, said condensation product being formed by condensing the foregoing reactants at a molar ratio of 2 mols of said aldehyde per mol of said phenol and a molar ratio of phenol to polyamine in the range of 1:1 to 2:1, respectively, at an elevated reaction temperature sufficient to form a polymerized condensation product.

2. The composition of claim 1 where (a) is N,N'disalicylidene-1,2-propylenediamine and (b) is a Mannich polymer prepared by condensing 2 moles of P-dodecyl phenol with 1 mole each of formaldehyde and ethylenediamine.

* * * * *